US005575504A

United States Patent [19]

Wagner

[11] Patent Number: 5,575,504

[45] Date of Patent: Nov. 19, 1996

[54] FILE FOLDER

[76] Inventor: Konrad Wagner, Ulrichstrasse 44, D-86316 Friedberg-Derching, Germany

[21] Appl. No.: 326,237

[22] Filed: Oct. 20, 1994

[30] Foreign Application Priority Data

Oct. 20, 1993 [DE] Germany ..... 9315962 U

[51] Int. Cl.[6] ..... B42F 7/00

[52] U.S. Cl. ..... 281/29; 402/73; 402/77; 412/3; 412/17

[58] Field of Search ..... 281/29; 402/73–77, 402/502; 412/3, 17

[56] References Cited

U.S. PATENT DOCUMENTS 4,219,951 9/1980 Schmidt ..... 402/75 X

*Primary Examiner*—Frances Han

*Attorney, Agent, or Firm*—Antonelli, Terry, Stout & Kraus

[57] ABSTRACT

A file folder which remains neatly open and neatly closed is comprised of a front, a back cover and a spine made in one piece and connected along two folds, and a groove milled along at least one of these folds.

6 Claims, 1 Drawing Sheet

FILE FOLDER

FIELD OF INVENTION

The invention relates to file folder structures.

BACKGROUND TO INVENTION

File folders are known to take many different forms. They primarily consist of cardboard material which is folded twice, so that a front cover, a back cover and a spine are created. The folds between the spine and the covers are usually made like a double fold and are produced by rolling. The file folders can include many different extra features, for example finger holes, binder inserts, document files and the like. Files which are equipped with a fastening device usually have, on their front cover in the area of the corresponding fold, two longitudinal openings, each provided with a barb into which the clips of the fastener engage when the file is closed. As a result, these files are secured against unintentional opening.

A disadvantage of the known files is that, due to the elasticity of the material in the region of the fold, they have the tendency to open when they are closed and close when they are open. Both effects are extremely annoying. Due to the fact that the closed file has the tendency to open, it must be wedged between other objects on a shelf in order to stand securely. Due to the closing tendency of the open file, the front cover must be continuously weighted when working in the file. Although the unintentional opening of the closed file can be prevented with aid of the aforementioned openings in connection with the two clips of the file, this only works in files having this type of clip mechanism and not in all other filing systems. Moreover, the tendency of the open file to close is not diminished.

A further disadvantage of these known files is that they offer an unaesthetic and bulgy appearance when they are standing on a shelf or lying on a table. This is due to the fact that the folds are relatively wide and the spine has the tendency to curve.

In another type of file, the two covers and the spine are not made as one piece, but the file cover essentially consists of three separate plates. These three plates must be provided with a plastic cover which has weld seams in the vicinity of the fold. Although these files close and open neatly and also have a suitable appearance, they are nevertheless expensive to manufacture, on the one hand, since a complete plastic covering and welding cannot be omitted and the three parts must be joined to one another so as to fit exactly. Secondly, these files only have a slight wear resistance since the folds are only formed by the plastic foils of the front and back which have been welded together and this plastic weld seam quickly tears.

SUMMARY OF THE INVENTION

It is an object of the invention to further develop a file in such a way that it remains neat both when open and closed, despite being less expensive to manufacture. In accordance with an embodiment of the invention, a file folder is comprised of a front, a back cover and a spine made in one piece and connected along two folds, and a groove milled along at least one of these folds.

BRIEF INTRODUCTION TO THE DRAWINGS

An embodiment of the invention will be described in greater detail below with reference to the attached drawings, in which.

Figure 3:
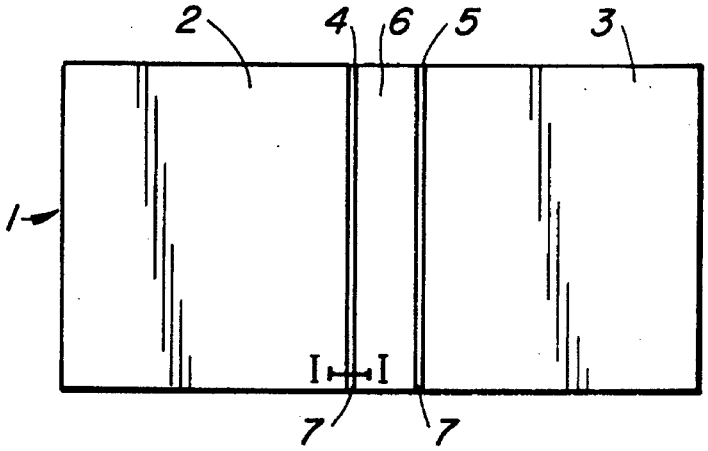
FIG. 3 is a top view onto the inside of an open file without inside fittings.
Figure 4A:
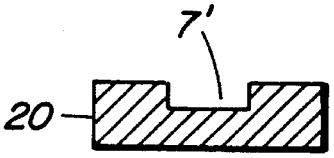
Figure 4B:
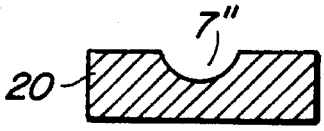
Figure 5:
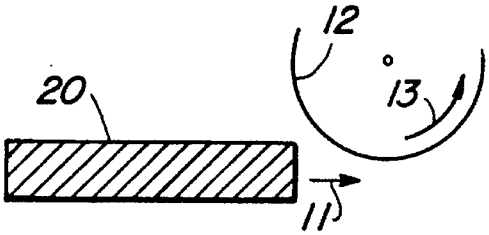

FIG. 4*a* is a section along the line I—I from FIG. 3;

FIG. 4*b* is an alternative form of the section along the line of I—I of FIG. 3;

FIG. 5 illustrates relative movement between cardboard material and milling head during the manufacturing process.

DETAILED DESCRIPTION OF THE INVENTION

Figure 1:
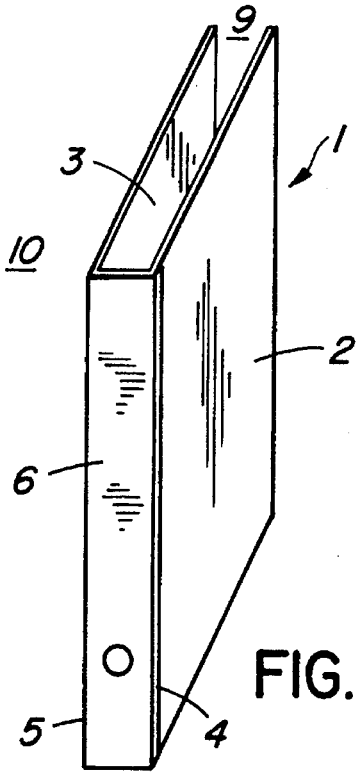
FIG. 1 is a schematic, perspective illustration of a closed file.

This file shown in FIG. 1 does not differ outwardly from a conventional file. It consists of a front cover 2 and a back cover 3 as well as a spine 6 connecting these two covers. Covers and spine are made as one piece from a cardboard material. The front cover 2 is connected via a fold 4 to the spine 6, and the back cover 3 is connected via a fold 5. When the covers 2 and 3 are properly folded about the folds 4 or 5, the form of a closed file shown in FIG. 1 is produced which has an inner side 9 and an outer side 10.

Figure 2:
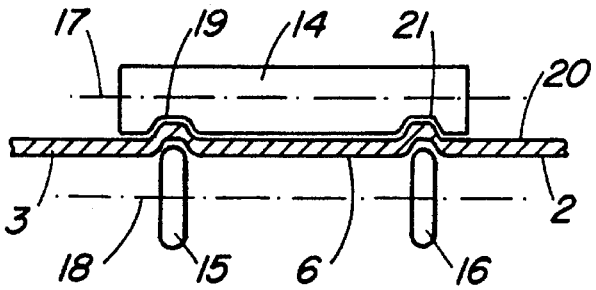
FIG. 2 illustrates making of two folds in a conventional file.

FIG. 2 shows the making of the two folds of a conventional file, which procedure can also be followed when making a file according to the invention. The cardboard 20, which is to later form the sides of the file 1, is guided (in a direction orthogonal to the plane of the drawing) through a rolling device which essentially consists of a long, cylindrical roller 14 and two small rollers 15 and 16. The long, cylindrical roller 14 is located on the one side of the cardboard 20 and rotates about an axis 17 situated parallel to the cardboard material 20 and at right angles to the direction of feed. The roller 14 has annular recesses 19 and 21 at two points on its periphery, the distance between them corresponding essentially to the desired width of the spine 6. The small rollers 15 and 16 located on the other side of the cardboard 20 rotate about a common axis 18, parallel to axis 17, and are spaced the same distance apart as the annular recesses 19 and 21. The long roller 14 is so close to the small rollers 15 and 16 that the cardboard 20 being guided through is pressed by the small rollers 15 and 16 into the recesses 19 and 21 of roller 14 and permanently shaped. As a result, folds 4 and 5 are produced at the position of rollers 15 and 16.

An open file 1 (without inside fittings) is shown in a top view FIG. 3. Fold 4 between front cover 2 and spine 6 as well as fold 5 between spine 6 and back cover 3 each has a groove 7 which runs along the corresponding fold 4 or 5 inside 9 the file 1. Grooves 7 are preferably 3 to 6 mm wide and about 1 to 2 mm deep. Different embodiments of grooves 7 (identified by reference number 7' and 7") are shown in FIG. 4. FIG. 4*a* shows a groove 7' which is rectangular in cross-section, whereas FIG. 4*b* shows a groove 7" which is segmental in cross-section.

Preferably, grooves 7 are milled into the cardboard material of the file 1. The round, rotating milling head 12 shown in FIG. 5 hereby rotates in a direction 13 in such a way that the operating direction of the milling head 12 runs in feed direction 11 of the cardboard material 20 worked. This results in the advantage that the cardboard material 20 is pressed inward, in direction of the groove 7 to be milled and is not pulled outward, as a result of which the edges of groove 7 are neatly cut. Preferably, the cardboard material

20 is fed to the milling device 12 in such a way that the fibers of the cardboard material run parallel to the direction of milling 13. This produces the cleanest edges for groove 7.

Preferably, the milled grooves 7 are subsequently coated with a permanent elastic adhesive. As a result, the fibers of the cardboard material 20 are embedded and the milled groove 7 does not fray.

Tests have shown that files made according to the invention can be opened and closed more than one hundred and fifty thousand time without any noticeable appearances of wear. In contrast thereto, conventional files are already torn after eighty thousand opening and closing actions. As a result of the material from the groove 7 being carried off during the milling process, the stresses in the area of folds 4 and 5 are substantially less than in conventional files and the file remains neatly closed or open. In addition, as a result of the slim fold 4 or 5 and the slight deformation of the spine 6, it also has a significantly aesthetic overall appearance as known files.

In an alternative embodiment (not shown), the grooves 7 are put on the outside 10 of the file 1 instead of on the inside 9. Furthermore, grooves 7 can be provided both on the inside and on the outside of the file 1. To obtain a neat inside 9 of the file 1, this inside 9 is usually coated with a covering foil prior to inserting the inside fittings of the file 1. The milled grooves 7 found on the inside 9 are also covered by this covering foil and are thus invisible.

As in the file folders 1 of the prior art, a rolling of the folds 4 and 5 can also take place when making the file 1 according to the invention, as shown in FIG. 2. However, this rolling is not a necessary prerequisite.

I claim:

1. A file folder comprising a front, a back cover and a spine formed of one piece of cardboard material and connected along two folds, the folds having been produced by rolling, two grooves milled along the two folds on the inside of the file having been produced by a milling head operating in a direction of feed of the cardboard material and parallel to the fibers of the cardboard material, the grooves being coated with a permanent elastic adhesive.

2. A file folder as defined in claim 1, in which each groove is rectangular in cross-section.

3. A file folder as defined in claim 1, in which each groove is segmental in cross-section.

4. A file folder as defined in claim 1, in which each groove has a width of between about 3 and 6 mm.

5. A file folder as defined in claim 1 further including a covering foil coating at least the inside of the covers and spine.

6. A method of producing a file folder formed of one piece of cardboard material and connected along two folds, comprising the steps of feeding the cardboard material, operating a milling head in a direction of feed of the cardboard material to mill a pair of grooves parallel to fibers of the cardboard material along predetermined fold line positions, rolling the cardboard material to fold the cardboard material along the fold lines to form the front, back cover and spine of the file folder with the milled groove inside the file folder, and coating the milled grooves with a permanent elastic adhesive.

* * * * *